US011833565B2

(12) United States Patent
Wolf et al.

(10) Patent No.: US 11,833,565 B2
(45) Date of Patent: Dec. 5, 2023

(54) DEVICE FOR FORMING A SHEET-METAL WORKPIECE

(71) Applicant: ALLGAIER WERKE GmbH, Uhingen (DE)

(72) Inventors: Michael Wolf, Uhingen (DE); Ottmar Lehr, Rechberghausen (DE); Dieter Waidmann, Heuchlingen (DE); Peter König, Göppingen (DE); Klaus Leinmüller, Iggingen-Brainkofen (DE)

(73) Assignee: Allgaier Werke GmbH, Uhingen Baden-Württemberg (DE)

( * ) Notice: Subject to any disclaimer, the term of this patent is extended or adjusted under 35 U.S.C. 154(b) by 725 days.

(21) Appl. No.: 15/084,215

(22) Filed: Mar. 29, 2016

(65) Prior Publication Data

US 2016/0207093 A1 Jul. 21, 2016

Related U.S. Application Data

(63) Continuation of application No. PCT/EP2014/070641, filed on Sep. 26, 2014.

(30) Foreign Application Priority Data

Sep. 30, 2013 (DE) ..... 10 2013 219 819.1

(51) Int. Cl.
*B21D 24/02* (2006.01)
*B21D 24/08* (2006.01)

(52) U.S. Cl.
CPC ..... *B21D 24/08* (2013.01); *B21D 24/02* (2013.01)

(58) Field of Classification Search
CPC ..... B21D 24/02; B21D 24/04; B21D 24/08; B21D 24/10; B21D 24/14; B21D 22/22; B21D 24/06; B21D 24/12; B30B 15/20
See application file for complete search history.

(56) References Cited

U.S. PATENT DOCUMENTS 2,294,451 A * 9/1942 Ernst ..... B21D 24/14 72/19.9
4,007,621 A * 2/1977 Franek ..... B21D 22/08 72/345

(Continued)

FOREIGN PATENT DOCUMENTS

CN 1101594 A 4/1995
CN 1136480 A 11/1996

(Continued)

OTHER PUBLICATIONS

Machine Translation of DE 4008377, Retrieved from Espacenet Mar. 28, 2028, 4 Pages. (Year: 1991).*

(Continued)

*Primary Examiner* — Debra M Sullivan
(74) *Attorney, Agent, or Firm* — Kinney & Lange, P. A.

(57) ABSTRACT

A device for forming a sheet-metal blank, the device including: a press frame; a tool top part including an outer die and an inner die; a tool base part including a punch and a sheet-metal holder; at least one drive assigned to the tool top part and/or the tool base part; and an annular sheet-metal holder surrounding the punch and having a support face; wherein one drive is in each case assigned to the inner die on the one hand, and to the outer die and the sheet metal holder on the other hand, and the one drive displaces the inner die and the outer die at different speeds in the drawing direction. A method of forming a sheet-metal blank including: using the device during a starting period, an intermediate phase, and a final phase where the movement and/or direction of the two dies vary.

17 Claims, 5 Drawing Sheets

(56) References Cited

U.S. PATENT DOCUMENTS

| | | | | | |
|---|---|---|---|---|---|
| 4,669,298 | A * | 6/1987 | Kono | B21D 24/00 | 100/299 |
| 5,241,849 | A | 9/1993 | Baur | | |
| 5,299,444 | A * | 4/1994 | Kirii | B21D 24/14 | 100/259 |
| 5,457,980 | A * | 10/1995 | Kirii | B21D 24/08 | 72/351 |
| 5,471,861 | A * | 12/1995 | Kirii | B21D 24/14 | 72/351 |
| 5,735,201 | A * | 4/1998 | Hirao | B21D 24/12 | 100/269.01 |
| 5,960,665 | A | 10/1999 | Schoellhammer | | |
| 6,014,883 | A * | 1/2000 | McClung | B21D 22/22 | 72/347 |
| 7,237,423 | B1 * | 7/2007 | Nagel | B21D 22/26 | 72/350 |
| 8,037,735 | B2 | 10/2011 | Kohno et al. | | |
| 9,216,448 | B2 * | 12/2015 | Schmeink | B21D 22/22 | |
| 2008/0098789 | A1 * | 5/2008 | Hori | B21D 22/02 | 72/349 |
| 2009/0071218 | A1 * | 3/2009 | Kohno | B21D 24/02 | 72/351 |
| 2010/0064759 | A1 * | 3/2010 | Kondo | B21D 22/208 | 72/342.3 |
| 2014/0090441 | A1 * | 4/2014 | Knoche | B21D 24/02 | 72/372 |

FOREIGN PATENT DOCUMENTS

| | | | | |
|---|---|---|---|---|
| CN | 2858098 | | 1/2007 | |
| DE | 27 27 174 | A1 | 12/1978 | |
| DE | 30 22 844 | A1 | 1/1982 | |
| DE | 40 08 377 | A1 | 9/1991 | |
| DE | 4008377 | A1 * | 9/1991 | |
| DE | 102 54 103 | B3 | 4/2004 | |
| DE | 102006010648 | A1 | 9/2006 | |
| DE | 102006021150 | A1 | 11/2007 | |
| DE | 10 2007 033 943 | A1 | 1/2009 | |
| DE | 10 2007 050 581 | A1 | 4/2009 | |
| DE | 102007050580 | A1 * | 4/2009 | B21D 22/22 |
| DE | WO 2012123583 | A1 * | 9/2012 | B21D 22/22 |
| DE | 10 2012 005 635 | B3 | 6/2013 | |
| EP | 2428290 | A1 | 3/2012 | |
| EP | 1 882 534 | B1 | 9/2014 | |
| JP | 58-4230 | | 6/1956 | |
| JP | S546853 | A | 1/1979 | |
| JP | H02205210 | A | 8/1990 | |
| JP | 2006315074 | A | 11/2006 | |
| JP | 2007075846 | A | 3/2007 | |
| KR | 20090008282 | U * | 8/2009 | |
| WO | 2006/000187 | A1 | 1/2006 | |
| WO | 2013139731 | A1 | 9/2013 | |

OTHER PUBLICATIONS

Machine Translation of KR 20090008282, Retrieved from Espacenet Sep. 16, 2022, 2 Pages. (Year: 2009).*

Machine Translation of DE 102007050580, Retrieved from Espacenet Sep. 26, 2022, 4 Pages. (Year: 2009).*

Canadian Office Action dated Aug. 29, 2017 for Canadian Application No. 2,921,109 (5 pages).

Japanese Office Action dated Jan. 12, 2017, including an English translation, for Japanese Application No. 2016-537350 (7 pages).

Notice of Transmittal of International Preliminary Report on Patentability dated Sep. 22, 2015 for International Application No. PCT/EP2014/070641 (14 pages).

Notice of Transfer of International Research Report and the Written Notice Issued for International Searching Authority or Statement dated Jan. 20, 2015 for International Application No. PCT/EP2014/070641 (12 pages).

* cited by examiner

DEVICE FOR FORMING A SHEET-METAL WORKPIECE

CROSS REFERENCE TO RELATED APPLICATIONS

This is a continuation of PCT application No. PCT/EP2014/070641, entitled "DEVICE FOR FORMING A SHEET-METAL WORKPIECE", filed Sep. 26, 2014, which is incorporated herein by reference.

BACKGROUND OF THE INVENTION

1. Field of the Invention

The invention relates to the field of processing metal workpieces, such as steel or other metals. It relates to a device for forming a workpiece, in particular a sheet-metal blank.

2. Description of the Related Art

Machining a workpiece may include any processes; e.g. cutting, pressing, drawing, and forming.

The workpieces are often pot-shaped components. Pot-shaped components include a base, a pot wall and a drawn edge. Such a component is often used as a spring cup for receiving the ends of a spiral spring. They are used in many ways, particularly in the automotive industry.

High-strength steels are problematic when producing such spring cups. In fact, said cups provide the advantage of extremely high tensile strengths, which is why steels of lower thickness and, consequently, of lower weight can be used. However, such steels are comparatively brittle and susceptible to cracking. This particularly occurs during forming at the highly-stressed transition regions. Cracking particularly occurs in the transition area between the pot base and the pot wall and between pot base and drawing edge.

DE 102 54 103 B3 describes a deep drawing tool for deep-drawing of molded parts. Said tool includes an annular clamping device for clamping a blank. The clamping device encloses a space, in which a base former and a wall former are displaceable in the drawing direction. Said formers may have different speeds, achieving a higher forming accuracy.

DE 27 27 174 C2 describes a method and a device for deep-drawing an aluminum container. Here, two parts, namely a punch and a die, are displaceable relative to one another. Here, the speed of the upward-moving punch can be greater than the speed of the downward-moving die. This achieving a great deep-drawing ratio.

DE IO 2007 050 581 A1 describes a method for influencing the sheet thickness profile when deep-drawing hollow bodies. This involves multi-stage bending (deforming) and re-bending (reforming) of a workpiece. During the reforming phase, the relative speed between punch and die is increased compared to the speed during the deforming phase. During the deforming phase, the punch performs a movement opposite to the reforming phase. The speeds of the punch during said phases are unequal.

WO 2006/000187 A1 describes a forming press for controlling a sheet metal holding force between a tool base part and a tool top part. In this case, electric drives are used, including a linear or rotatory direct drive for applying a pressure to the sheet metal holder.

DE 10 2012 005 635 B3 describes a plant and a method for forming a sheet metal blank. However, the plant shown operates neither with pneumatic or hydraulic cushions nor with pressure bolts.

DE 10 2007 033 943 A1 describes a press for forming workpieces. This document deals with the compensation of undesired deformations of the workpiece in the press.

The risk of cracking of the workpiece during the forming process is present in all known devices. Such a cracking mainly occurs in the edge regions of the workpiece as well as with greater drawing depths.

One or more drawing cushions are provided in the prior art, moving as fast as the press ram during the drawing process in the displacement mode. The ram cushion is displaced at ram speed even during working operation.

SUMMARY OF THE INVENTION

The object of the invention is to configure a device, a plant, a method and a workpiece such that high-strength steels are formable without cracking occurring in the edge regions, and a greater drawing depth is achieved than before.

The invention has numerous advantages:

The drawing operation per se is controlled, not other things.

The drives directly act upon the respective tool part, i.e. without interposing functional parts. Parts serving exclusively for transmitting the forces, such as the bolts, for example, can be used here. Nevertheless, an indirect action is possible as well.

By interposing one or multiple servo units, the bolts are loaded not abruptly, but smoother than before. The loading process and thus also the impact of the bolts to the workpiece is effected within a time period, which takes only few milliseconds more than in known devices. As a result, cracking risk is considerably minimized, and workpieces of high quality and strength are produced.

According to another concept of the invention, the device is configured such that the inner die and the outer die can be displaced at different speeds in the drawing direction during the forming process. To that end, in each case a special drive—where required together with the sheet-metal holder—is assigned to the outer die and the inner die, which drive displaces said two dies in the drawing direction at different speeds during the forming process—in the following referred to as a "Variotempo unit". In a press having a Variotempo unit, the servo unit moves at a higher speed than the ram of the press in the drawing direction, i.e. in the direction of the ram.

Multiple Variotempo units may be provided, distributed over the impact area of the press. This can be of importance in large components, such as mud wings for automobiles. In such components, the load to the workpiece—during forming or in operation—can be particularly great, so that it is recommended to provide a Variotempo unit on the respective locations of the workpiece during forming.

A Variotempo unit can be arranged on the pressing table or in the press ram or in both said devices. It can be arranged on or in a floating plate, said floating plate being a plate that distributes the pressing force over a face. Variotempo units can also be installed in existing pressing facilities at a later time.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
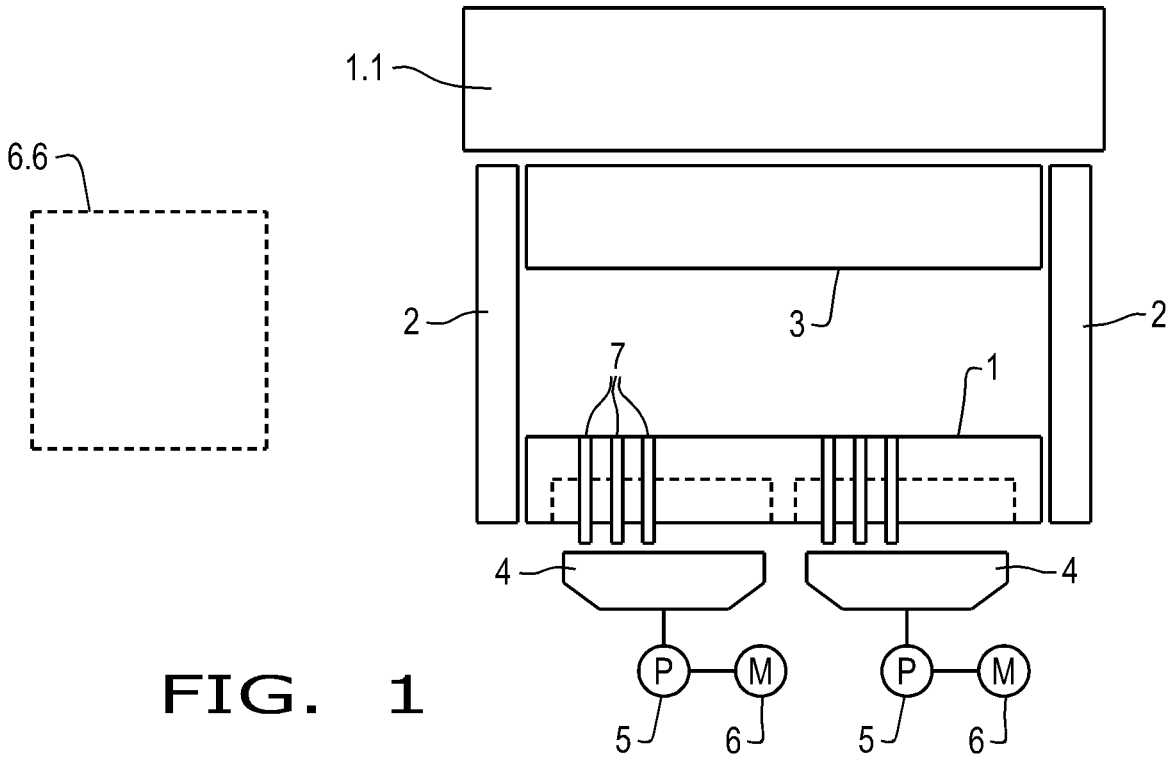
FIG. 1 schematically illustrates an embodiment of a press frame of the present invention having an integrated servo unit assigned to the pressing table and an optional controller.

Referring to FIG. 1, the press frame includes a pressing table 1, columns 2, a crosshead 1.1, and a ram 3. Between the pressing table 1 and the ram 3, a die and a punch (neither shown here), support workpiece top parts and workpiece base parts, respectively. An optional controller 6.6 is shown that can control the bolt movements and the entire press frame relative to each other.

A servo unit includes two servo cushions 4 in the form of hydraulic chambers, further in each case one servo pump 5 and one servomotor 6. Bolts 7 are arranged in the pressing table 1. Said bolts can be loaded by the respective servo cushion 4, such that they move upwards and downwards in a vertical direction.

Each servo cushion 4 may be assigned to a different number of bolts 7. Thus, one individual bolt can be assigned to one servo cushion. However, it is as well possible assigning two or more bolts to one servo cushion.

The operating medium of the servo unit is a liquid. It could be a pneumatic system just as well.

Figure 2:
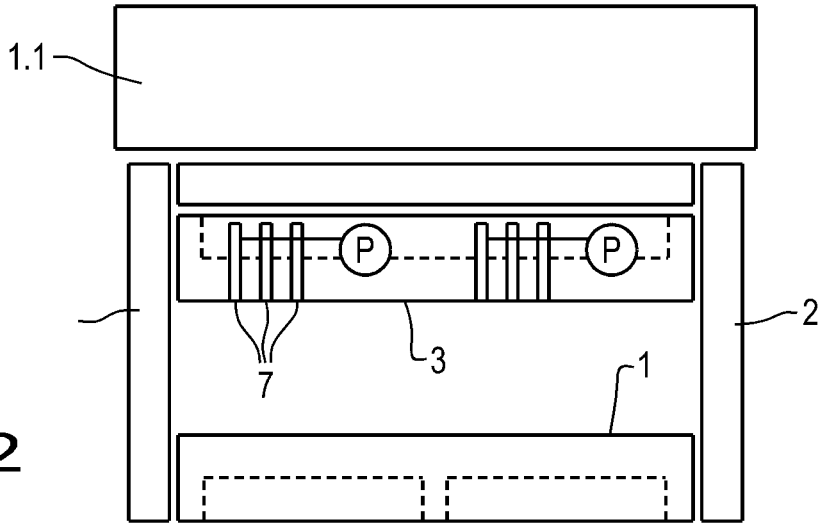
FIG. 2 schematically illustrates an embodiment of a press frame of the present invention having an integrated servo unit assigned to the ram of the press.

In FIG. 2, the servo unit is assigned to the ram 3. Only pump 5 is indicated.

In the two embodiments according to FIGS. 1 and 2, the servo unit is constructionally integrated in the pressing table or the bolt, respectively.

Figure 3:
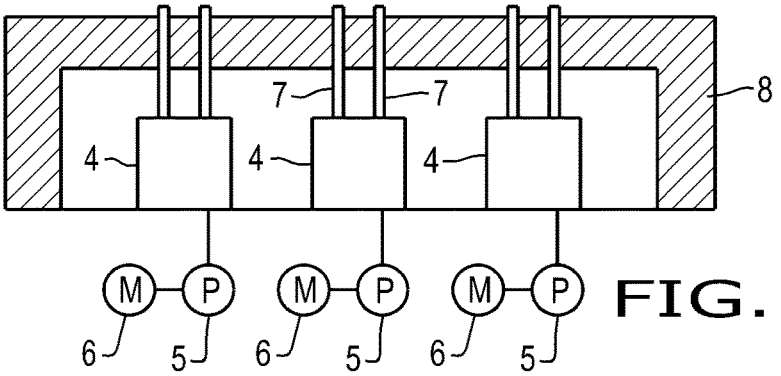
FIG. 3 schematically illustrates an embodiment of a servo unit of the present invention.
Figure 4:
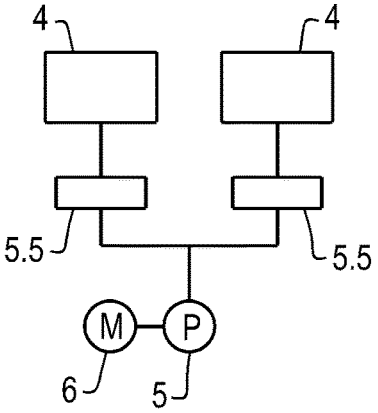
FIG. 4 schematically illustrates an embodiment of a servo motor, a servo pump, a plurality of control valves and a plurality of hydraulic servo cushions.

In FIG. 3, the servo unit is illustrated in greater detail, again schematically. Here, it is integrated in a punch 8. Instead of the punch, the servo unit could just as well be integrated in a die. In FIG. 4 element 5.5 is a control valve of servo cushion 4.

Three servo cushions 4 can be seen. Each servo cushion 4 acts upon two bolts 7. Each servo cushion 4 is loaded by a servo pump 5, which is driven by a servomotor 6.

Here, one distinct servomotor pump set can be assigned to each servo cushion 4. However, it is also possible that multiple servo cushions 4 are acted upon by one single servomotor pump set. In this case, a control valve (not shown) is arranged upstream of each servo cushion 4. In general, the control of the press frame, respectively of the forming process, will be connected to the control of the servo cushion(s).

Figure 5:
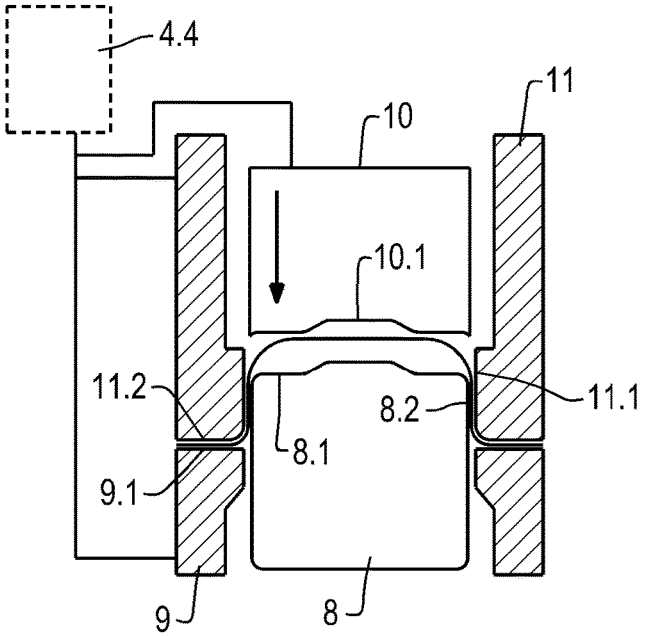
FIG. 5 illustrates a cross-sectional view of a drawing device of the present invention with an already-formed workpiece in a first forming stage of the forming stroke, the servo unit omitted.
Figure 6:
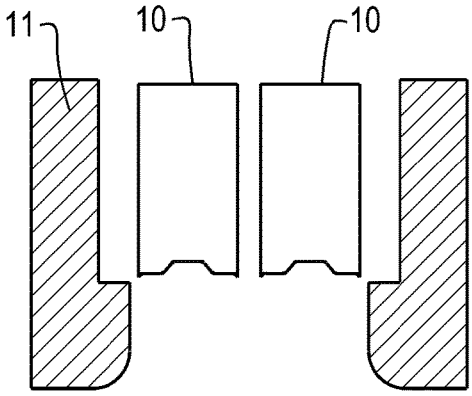
FIG. 6 illustrates a multitude of inner dies.

The drawing device illustrated in FIG. 5 includes a punch 8 and a sheet-metal holder 9. The punch 8 has a slightly conical shape. A controller 4.4 provides control to the system. It includes a base-forming face 8.1 and a wall-forming face 8.2. The concepts illustrated in FIGS. 1-3, including servo unit and bolts, are not illustrated in FIG. 5. However, it is understood that the concepts are incorporated in the drawing device according to FIG. 5.

The punch 8 is enclosed by the sheet-metal holder 9. The sheet-metal holder 9 includes a support face 9.1 The sheet-metal holder 9 is of annular shape.

An inner die 10 is located above the punch 8. The die is at least approximately cylindrical. It is enclosed by an outer die 11. Said die is of annular shape.

The inner die 10, in turn, has a base-forming face 10.1. The outer die 11 is of annular shape. It includes a wall-forming face 11.1, further a clamping face 11.2 for clamping the drawing edge 12.3 of a workpiece 12 on the support face 9.1 of the sheet metal holder 9.

Figure 8:
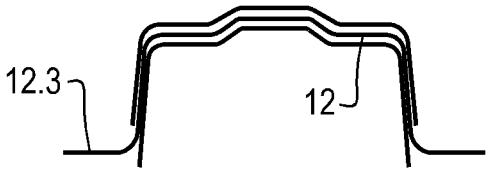
FIG. 8 illustrates the workpiece just before the end of the second forming stage.
Figure 9:
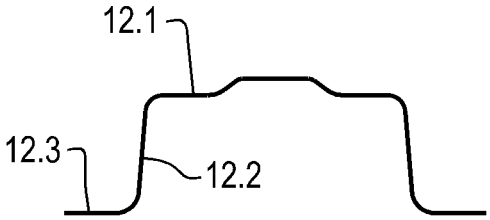
FIG. 9 illustrates the workpiece at the end of the forming process.
Figure 10:
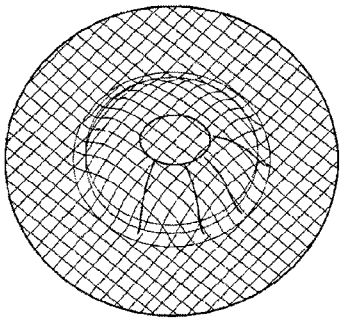
FIGS. 10-15 illustrate the forming process in six different forming stages.
Figure 11:
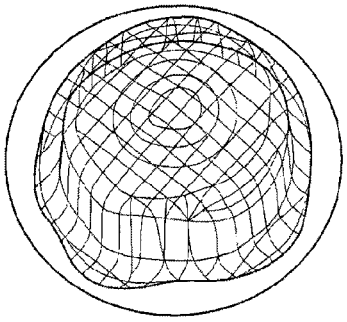
Figure 12:
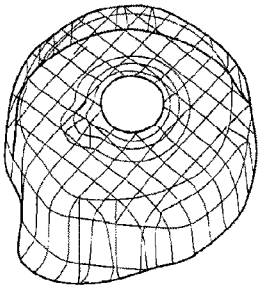
Figure 13:
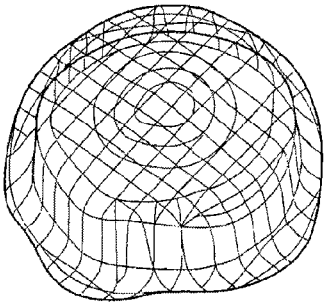
Figure 14:
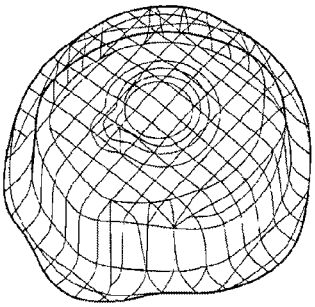
Figure 15:
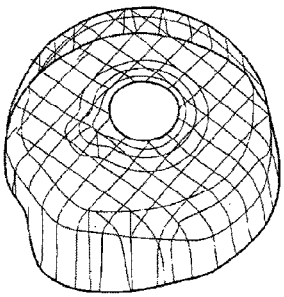

The workpiece 12 has emerged from a circular-plate-shaped blank. It includes a base 12.1, a wall 12.2 as well as the mentioned drawn edge 12.3 (FIGS. 8-9).

Figure 7:
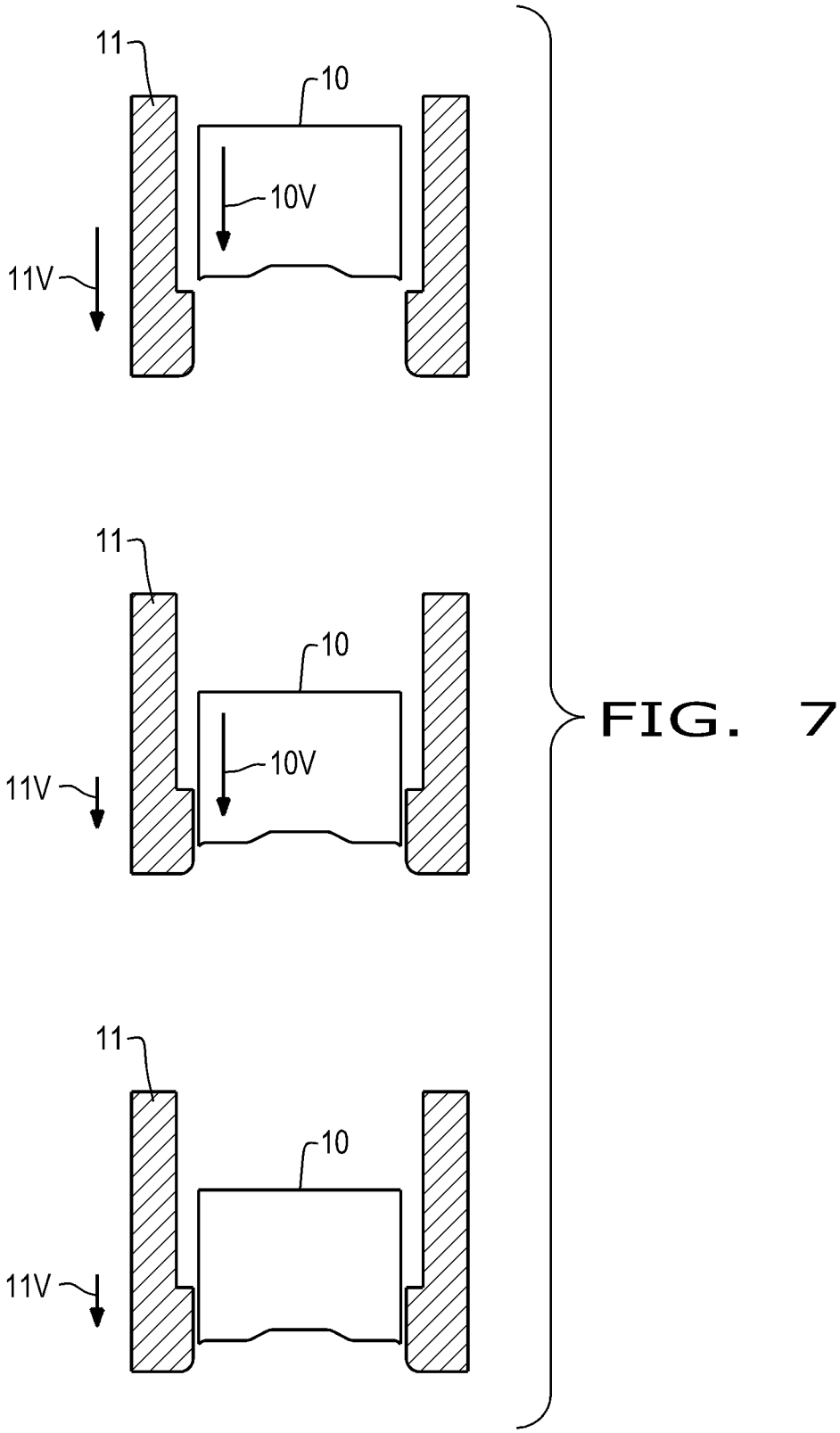
FIG. 7 illustrates a method of forming a sheet metal blank.

As illustrated in FIG. 7, the drawing device operates as follows: First it is open, that means that the clamping face 11.2 of the outer die 11 is located approximately at the height of the base-forming face 10.1 of the inner die 10. The support face 9.1 of the sheet-metal holder 9 is located at the same height or even higher, sufficient for inserting the workpiece 12.

In this phase, a workpiece 12 is inserted in the drawing device and clamped between the support face 9.1 and the clamping face 11.2. Now, the actual operating phase of the drawing device starts. Here, the inner die 10 moves at speed 10V and the outer die 11 at speed 11V move downwards together with the preformed workpiece 12, as well as with the sheet-metal holder 9. Here, the mentioned parts (inner die 10, outer die 11, sheet-metal holder 9 and preformed workpiece) have the same speed.

According to the invention, this changes in a subsequent phase. Here, the inner die 10 overtakes the outer die 11. (Speed 10V is greater than 11V) In turn, in another subsequent phase, the outer die 11 overtakes the inner die 10. (Speed 11V is greater than 10V) It should be noted that this may be effected vice versa.

The drawing device illustrated in FIG. 5 is only one station in a series of drawing stations. Said stations are not illustrated here. In practice, they are connected in series in a factory.

Here, only one individual drawing station needs to be configured according to the invention, i.e. provided with drives, which are capable of providing different speeds to the inner die 10 on the one hand, the outer die 11 and the sheet metal holder 9 on the other hand during the drawing process.

The appearance of the workpiece after leaving the different drawing stations can be seen in FIGS. 10-15.

The advantages of the invention can be summarized as follows:

The forming process operates in an optimum manner and results in high-quality workpieces.

The invention can be applied particularly successfully in large-scale workpieces such as mud wings. These can be subjected to different forming processes at different points, of accordingly different material loads. In the case that multiple Variotempo units are used, spread over the entire workpiece area, this can be addressed in that the ratio of the speeds in the inner die and in the outer die is set accordingly during the forming process.

An overall controller can be realized comparatively simply, wherein controlling the bolt movements on the one hand and the entire press on the other hand can be adapted to one another in a simple manner.

The system can readily be realized in existing facilities.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

LIST OF REFERENCE NUMERALS

1 Pressing table
2 columns
3 ram
4 servo unit in the form of hydraulic chambers
5 servo pump
6 servomotor
7 bolt
8 punch
8.1 base-forming face
8.2 wall-forming face
9 sheet-metal holder
9.1 support face
10 inner die
10.1 base-forming face
11 outer die
11.1 wall-forming face
11.2 clamping face
12 workpiece
12.1 workpiece base
12.2 workpiece wall
12.3 drawing edge

What is claimed is:

1. A device for forming a sheet-metal blank, the device comprising:

a press frame including a pressing table, vertical columns, a cross head, and a ram;

a tool top part including an inner die and an outer die;

a tool base part including a punch and a sheet metal holder; and at least one drive configured to move the inner die, the outer die, and the sheet metal holder in a vertical direction, wherein the at least one drive is configured to displace the inner die and the outer die at different speeds in a drawing direction, the at least one drive including:

a plurality of bolts arranged vertically slideable in the drawing direction; and wherein one or more of the plurality of bolts directly contact at least one of the punch or the sheet metal holder and induce a force on the at least one of the punch or the sheet metal holder to translate the at least one of the punch or the sheet metal holder in the drawing direction;

wherein one or more of the plurality of bolts are positioned within and extend [at least partially] through the punch.

2. The device of claim 1, wherein a plurality of servo cushions are configured to induce a force on one or more of the plurality of bolts in the drawing direction to vertically translate one or more of the plurality of bolts in the drawing direction.

3. The device of claim 2, wherein a first servo pump driven by a first servomotor loads a first servo cushion to induce a force on at least one of the plurality of bolts; and wherein a second servomotor loads a second servo cushion to induce a force on at least one of the plurality of bolts; and wherein a third servomotor loads a third servo cushion to induce a force on at least one of the plurality of bolts.

4. The device of claim 2, wherein one or more of the plurality of servo cushions induces a force on two or more of the plurality of bolts in the drawing direction to vertically translate one or more of the plurality of bolts in the drawing direction.

5. The device of claim 1, wherein:

the inner die includes a base-forming face configured to form the base of the sheet metal blank;

the outer die includes a wall-forming face configured to form walls of the sheet metal blank, the wall-forming face is positioned substantially perpendicular to the base-forming face; and the outer die includes a clamping face configured to clamp a peripheral surface of an emerging workpiece.

6. The device of claim 5, wherein:

the punch includes a base-forming face configured to form the base of the sheet metal blank and a wall-forming face configured to form walls of the sheet metal blank, the wall-forming face is positioned substantially perpendicular to the base-forming face; and the sheet metal holder includes a support face, wherein the sheet metal blank is positioned and secured between the clamping face and the support face during the forming process.

7. A device for forming a sheet-metal blank, the device comprising:

a press frame including a pressing table, vertical columns, a cross head, and a ram;

a tool top part including an inner die and an outer die;

a tool base part including a punch and a sheet metal holder; and at least one drive configured to move the inner die, the outer die, and the sheet metal holder in a vertical direction, wherein the at least one drive is configured to displace the inner die and the outer die at different speeds in a drawing direction, the at least one drive including:

a plurality of bolts arranged vertically slideable in a drawing direction;

wherein one or more of the plurality of bolts are positioned within the ram;

wherein one or more of the plurality of bolts directly contact at least one of the inner die or the outer die and induce a force on the at least one of the inner die or the outer die to translate the at least one of the inner die or the outer die in the drawing direction; and wherein one or more of the plurality of bolts are positioned within and extend [at least partially] through the ram.

8. The device of claim 7, wherein:

the inner die includes a base-forming face configured to form the base of the sheet metal blank;

the outer die includes a wall-forming face configured to form walls of the sheet metal blank, the wall-forming face is positioned substantially perpendicular to the base-forming face;

the outer die includes a clamping face configured to clamp a peripheral surface of an emerging workpiece;

the punch includes a base-forming face configured to form the base of the sheet metal blank and a wall-forming face configured to form walls of the sheet metal blank, the wall-forming face is positioned substantially perpendicular to the base-forming face; and the sheet metal holder includes a support face, wherein the sheet metal blank is positioned and secured between the clamping face and the support face during the forming process.

9. The device of claim 7, wherein a plurality of servo cushions are configured to induce a force on one or more of the plurality of bolts in the drawing direction to vertically translate one or more of the plurality of bolts in the drawing direction.

10. The device of claim 9, wherein one or more of the plurality of servo cushions are pneumatic or hydraulic servo cushions, and wherein a servo unit including a servo pump driven by a servomotor loads one or more of the plurality of servo cushions to induce the force on one or more of the plurality of bolts.

11. The device of claim 10, wherein a control valve is configured to alter a pressure and an amount of a medium supplied to one or more of the plurality of servo cushions to adjust the force induced on one or more of the plurality of bolts.

12. The device of claim 9, wherein one or more of the plurality of servo cushions induces a force on one of the plurality of bolts in the drawing direction to vertically translate one or more of the plurality of bolts in the drawing direction.

13. The device of claim 9, wherein one or more of the plurality of servo cushions induces a force on two or more of the plurality of bolts in the drawing direction to vertically translate one or more of the plurality of bolts in the drawing direction.

14. A device for forming a sheet metal blank, comprising:

a press frame with a press table, vertical columns, a crosshead, an inner die an outer die and a punch;

a plurality of bolts that extend through the punch;

at least one servo unit associated with at least one of plurality of bolts;

the servo unit comprises the plurality of bolts arranged in the punch so as to be vertically slidable in the operating direction of the punch;

a plurality of chambers acting on one or more of the bolts in the pressing direction;

a servo pump acting on the chambers, driven by a servo motor.

15. The device of claim 14, wherein that the servo unit is associated with one or more bolts.

16. The device of claim 15, wherein one or more of the plurality of chamber is pneumatic.

17. The device of claim 14, wherein one or more of the plurality of chambers is hydraulic.

* * * * *